United States Patent [19]

Shing-Hsiung

[11] 4,231,712

[45] Nov. 4, 1980

[54] SEA WATER LIFTING DEVICE

[76] Inventor: Wu Shing-Hsiung, 1, Lane 2, Chung Chen Rd., Tan Sui, Taipei Hsiuen, Taiwan

[21] Appl. No.: 12,817

[22] Filed: Feb. 16, 1979

[51] Int. Cl.[3] ..... F04F 1/02

[52] U.S. Cl. ..... 417/100; 417/121

[58] Field of Search ..... 417/100, 103, 121

[56] References Cited

U.S. PATENT DOCUMENTS 3,829,246 8/1974 Hancock ..... 417/150

*Primary Examiner*—Edward L. Roberts

*Attorney, Agent, or Firm*—Holman & Stern

[57] ABSTRACT

A device for transmitting sea water from a lower level to a higher level by means of sea surge striking the intake pipe to generate air pressure in a sealed chamber and to cause the water therein to be transmitted upwards into the next higher sealed chamber. The sea water is finally lifted to a reservoir at a given elevation.

4 Claims, 6 Drawing Figures

SEA WATER LIFTING DEVICE

This invention relates to devices for utilizing the energy from sea waves for lifting water to a reservoir.

The requirements for electrical power have constantly increased around the world. The rise in the standard of living for many people and the consequent increase in the use of electrical appliances accounts for a portion of the increase.

New power source developments are mainly in the field of huge nuclear power plants. Unfortunately, these are subject to many disadvantages. For example, they are very expensive to develope and install. Many new dangers are presented in the possible contamination of the environment. The seas may become contaiminated by a release of nuclear materials to the sea water which is used for cooling purposes.

Another type of power plant presently available is a standard fossil fuel fired one. These are subject to the disadvantages of considerable cost to build and the ever-escalating costs of fossil fuels to operate.

The most economic type of power plant is the hydroelectric plant if the cost of locating an ideal reservoir is not considered. Ideal locations for such plants are difficult to find and additionally are subject to the potential adisadvantage of droughts. A tremendous amount of effort is presently being expended in the search for a new source of energy.

OBJECTS AND SUMMARY OF THE INVENTION

This invention is a free energy sea water reservoir device, which comprises many stories of vertically-structured sealed chambers. Each chamber is provided with a water inlet, an air inlet and a water outlet. The air and water inlets are in the upper portion of the chamber and the water outlet is in the lower portion. Water transmission means connect each water outlet with the water inlet of the chamber above for transmitting water up the device. Each water inlet has a first check valve means for letting water into the chamber. Each water outlet has a second check valve means for letting water out of the chamber. Intake pipe means are connected to each air inlet from from the base of the device which is in the sea. These are for transmitting pressure from sea waves compressing and exhausting the air in the pipe means. The successive surges from the sea waves alternatingly compress and exhaust the air in the intake pipe means and the sealed chambers. The water in each chamber is thus forced out through the water outlet and the water transmission means to the next chamber stacked above. The water outlet of the uppermost chamber is connected to a reservoir.

The water transmission means includes a spare reservoir associated with and connected to the upper portion of each sealed chamber at its water inlet. A water transmission pipe connects each water outlet to the spare reservoir of the chamber above. The intake pipe means includes a plurality of intake pipes. Each intake pipe has an inlet portion which rests on the sea floor open in the direction from which the waves are coming. A floating sealed drum can be slidingly fitted in the inlet portion of each intake pipe. The drum serves as a compression piston moved by the waves.

The sea water will be transmitted through the device from a lower level to a higher level or a reservoir at a given elevation; the water in the reservoir may be, but is not limited to, use for hydroelectric power plant. The operation theory of this device is to use the sea surge striking and retreating from the intake pipe to generate air compression and air exhaustion effects to cause the sea water in the base sealed chamber to be transmitted upwards to the next higher chamber and so on until to the top one.

DETAILED DESCRIPTION OF A PREFERRED EMBODIMENT

The present invention can transmit the sea water to a reservoir at higher level by means of the surging power of sea water so as to fulfill the purpose of hydroelectric power plant.

Figure 1:
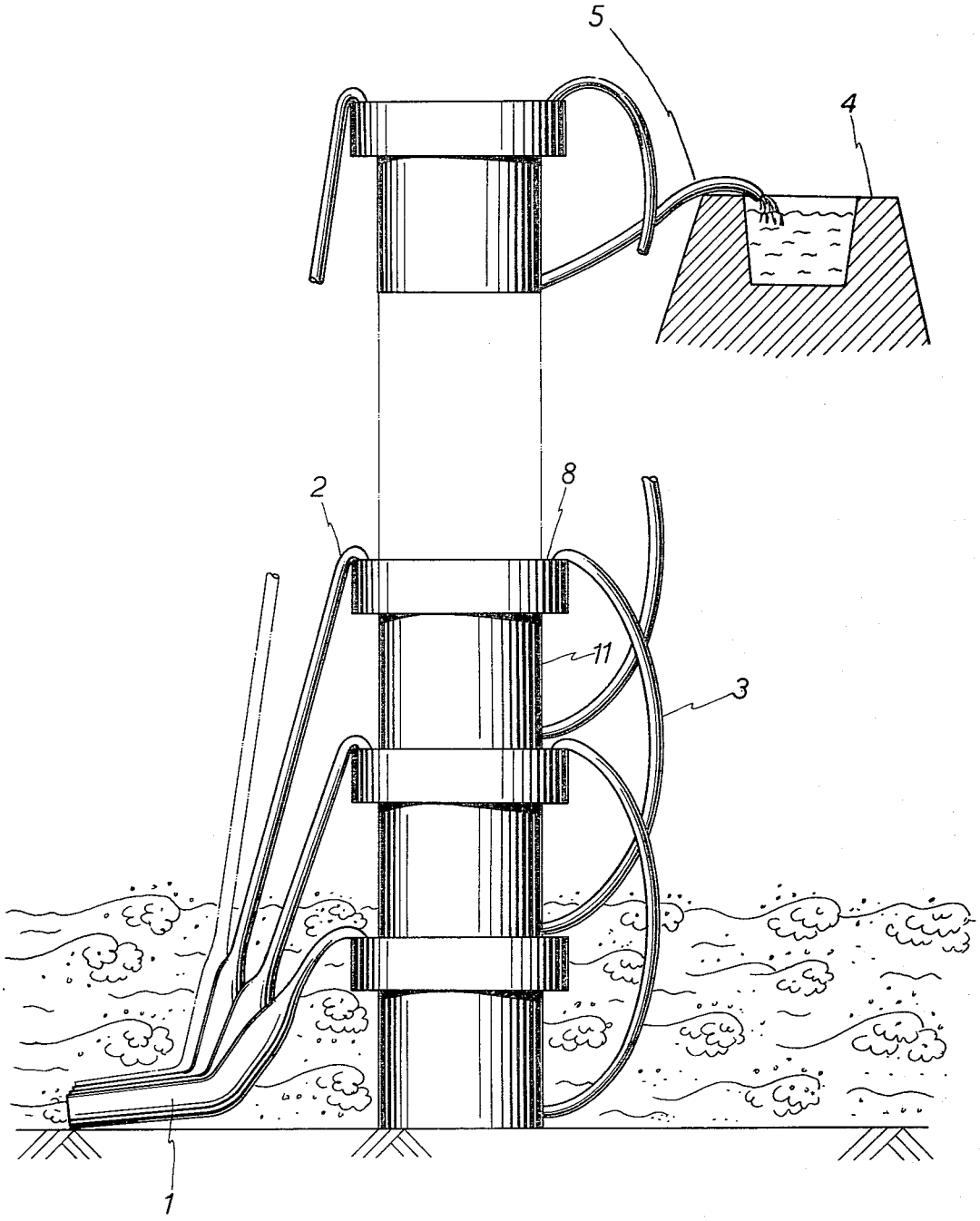
FIG. 1 is the outer view of this invention.
Figure 2:
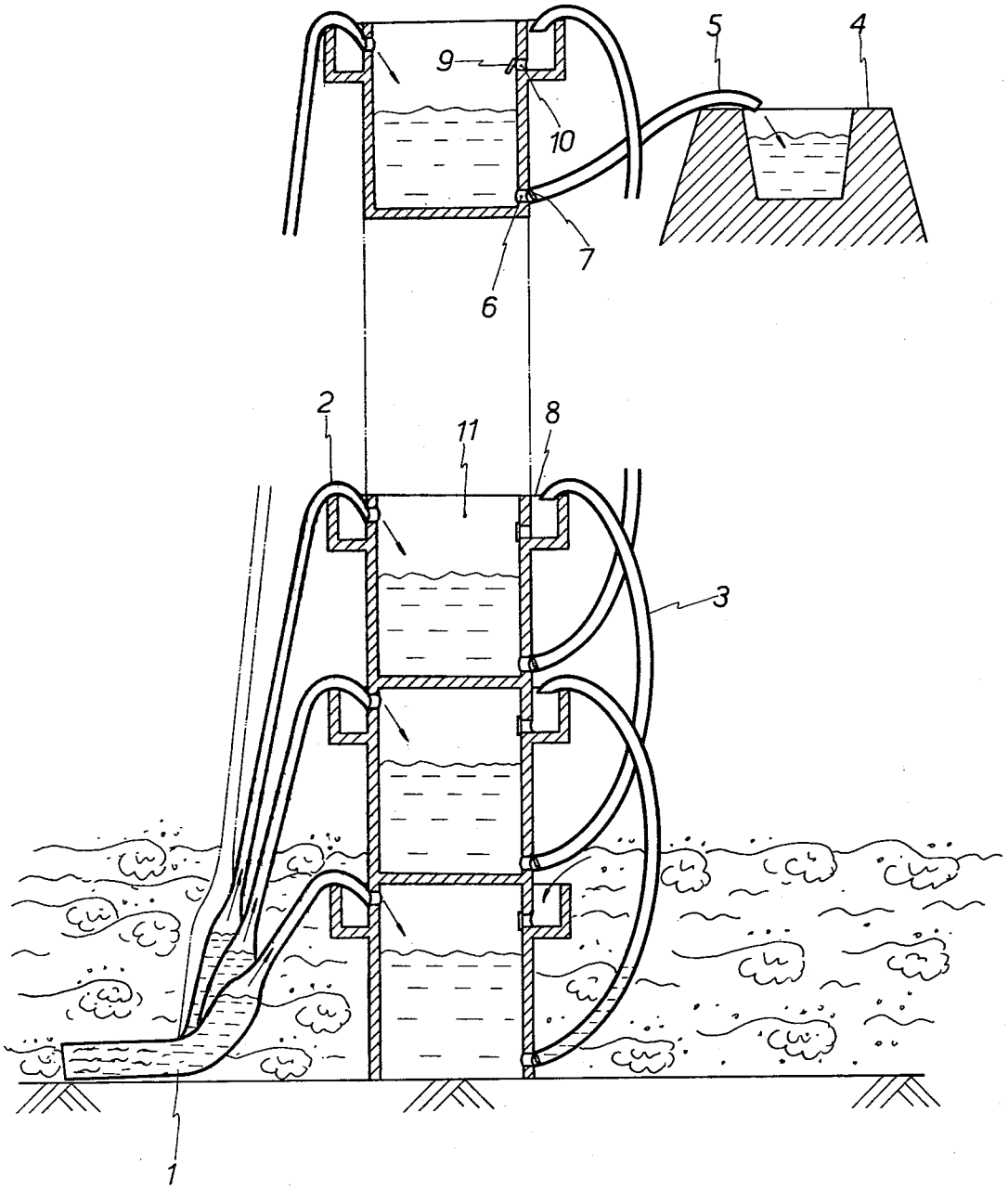
FIG. 2 is a cross-sectional view of this invention.
Figure 5:
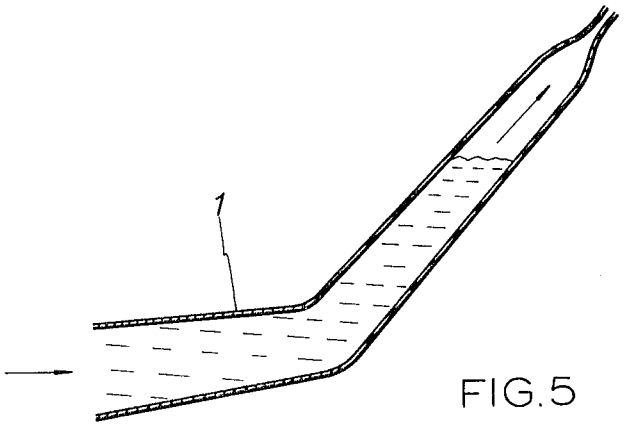
FIGS. 5 and 6 are partial cross-sectional views of the intake pipe means of this invention.

FIG. 1 shows the invention with a plurality of sealed chambers (11), one on top of the other. Each sealed chamber (11) has an intake air pipe (2) and one water transmission pipe (3). The special feature of this invention is to use the permanent surging of waves as the initial power to push sea water into intake pipe (1), which can be made in various manners as shown in FIG. 5, the empty type, and in FIG. 6, the floating drum type. When sea water rushes into intake pipe (1), the air in the pipe is compressed which generates a pressure which will enter in the sealed chamber in every story (11) through airpipes (2). Then, the water is sealed chamber (11) will press the outlet valve (7) open and enter into the spare reservoir (8) of the next above chamber through water transmission pipe (3) until the pressure is exhausted, or in other words until the sea surging wave is retreating as shown in FIG. 2. At the same time, the inlet valve (9) of each story will be closed as a result of air pressure in the sealed chamber (11) so as to let the moving water be stored in the spare reservoir (8).

Figure 6:
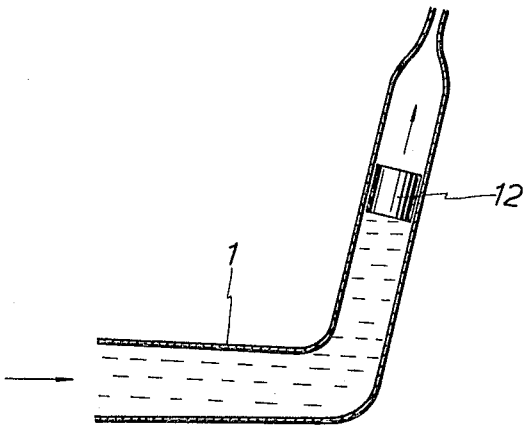
Figure 3:
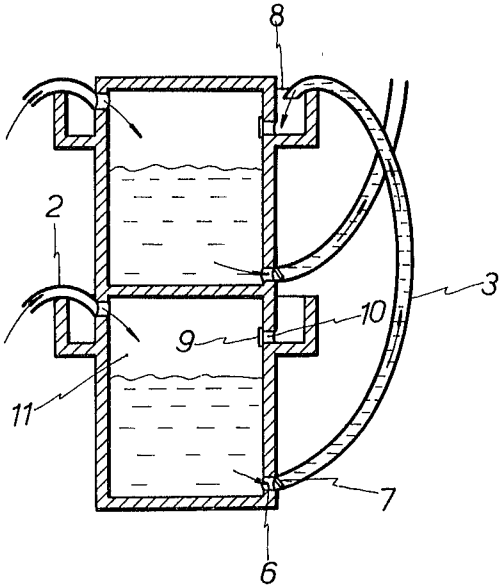
FIG. 3 is a partial cross-sectional view of this invention (when the sea is surging)
Figure 4:
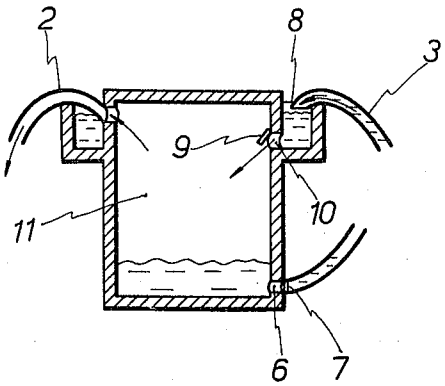
FIG. 4 is a partial cross-sectional view of this invention (when the sea surge retreats)

FIG. 4 shows that when the surging wave retreats, there will be an exhausting force generated in the intake pipe (1), and the air in the sealed chamber (11) will also be drawn away through air pipe (2). Simultaneously, there are two things happening, i.e., the outlet valve (7) will be closed because of the water pressure in water transmission pipe (3), and the inlet valve (9) will be opened because of the exhausting force in the sealed chamber (11); then, the water in spare reservoir (8) will flow into the sealed chamber (11). Except the water in spare reservoir (8) of bottom story being directly supplied by sea waves, the water in the remaining sealed chambers (11) will be supplied from the next lower chamber. It is apparent that this invention can transmit the sea water from sea level until the water flows to the reservoir (4) through the top water pipe (5). This invention is designed to be installed along the sea coast which is always being struck by sea surges. The number of towers to be installed is dependent upon the volume of water required by the reservoir (4) designed. As shown in FIGS. 5 and 6, the intake pipe (1) can have a floating drum (12) installed therein. The drum (12) acts as a compression seal and piston and is slidingly fitted in the pipe. As the water strikes the drum, it is moved upwards compressing the air ahead of it. This in turn operates the system as described above.

The drum (12) can be made of aluminum alloy or an aluminum-zinc alloy. It should be corrosion resistant. The tower can be made of cement or concrete. The intake pipe (1) can be made of aluminum alloy or the like. The water transmission pipes (3) and (5) can be made of plastic, steel, rubber or other conventional piping material. The valves of the outlets (7) and inlets (9) can be made of metal such as copper, steel, or the like and preferably have a rubber coating. The size and height of the sealed chambers, number of stories needed, and the size of the piping are all dependent on the particular reservoir to which the water is being transmitted and the frequency and force of the sea in the locality.

The advantages of the present invention are readily apparent. It is simple to build, easy and inexpensive to maintain and is not affected by weather. No manpower is needed to operate it. During the energy crisis epoch, this invention might be considered as a most economical, and a most valuable device for providing more energy sources.

What I claim is:

1. A sea water reservoir device having a base in the sea comprising a plurality of vertically stacked sealed chambers, each having an upper portion and a lower portion, an air inlet in the upper portion of each chamber, a water inlet in the upper portion of each chamber, a water outlet in the lower portion of each chamber, water transmission means connecting each water outlet with the water inlet of the chamber above for transmitting water up the device, first check valve means in each water inlet for only letting water in, second check valve means in each water outlet for only letting water out, and intake pipe means connected to each air inlet from the base of the device for transmitting pressure from sea waves compressing and exhausting air in said pipe means whereby the successive surges from the sea waves alternatingly compress and exhaust the air in said intake pipe means and each sealed chamber thereby forcing water through said water outlets and said water transmission means to the next chamber stacked above, the water outlet of the uppermost chamber being connected to a reservoir.

2. The device of claim 1, wherein said water transmission means comprises a plurality of spare tanks, each associated with and connected to the upper portion of one of said chambers at said water inlet, and a plurality of water transmission pipes connecting said water outlet of each chamber to said spare tank of the chamber above.

3. The device of claim 2 or 3 wherein said intake pipe means comprises a plurality of intake pipes having inlet portions resting on the sea floor.

4. The device of claim 3 wherein said intake pipe means further comprises a plurality of floating drums, one each slidingly fitted in each inlet portion.

* * * * *